US005407774A

United States Patent [19]

Matsushima et al.

[11] Patent Number: 5,407,774

[45] Date of Patent: Apr. 18, 1995

[54] CHARGE CONTROL AGENT AND POSITIVELY CHARGEABLE TONER FOR DEVELOPING ELECTROSTATIC IMAGES

[75] Inventors: Chiemi Matsushima, Moriguchi; Tetsuji Kihara, Takatsuki; Shun-ichiro Yamanaka, Hirakata; Kazuaki Sukata, Yawata, all of Japan

[73] Assignee: Orient Chemical Industries, Ltd., Osaka, Japan

[21] Appl. No.: 91,323

[22] Filed: Jul. 14, 1993

[30] Foreign Application Priority Data

Jul. 15, 1992 [JP] Japan ..... 4-212079

[51] Int. Cl.[6] ..... G03G 9/097

[52] U.S. Cl. ..... 430/110; 430/115

[58] Field of Search ..... 430/110, 115

[56] References Cited

U.S. PATENT DOCUMENTS

| | | | |
|---|---|---|---|
| 1,716,797 | 6/1929 | Savage . | |
| 2,396,710 | 3/1946 | Levey et al. | 252/305 |
| 4,826,749 | 5/1989 | Kawagishi et al. . | |
| 4,980,258 | 12/1990 | Aoki et al. . | |
| 4,988,600 | 1/1991 | Kok et al. | 430/110 |

FOREIGN PATENT DOCUMENTS

| | | | |
|---|---|---|---|
| 0242420 | 4/1986 | European Pat. Off. . | |
| 0209990 | 5/1988 | European Pat. Off. | B41M 5/26 |
| 0387201 | 3/1990 | European Pat. Off. | C09B 67/22 |
| 748650 | 7/1933 | France | 13/3 |
| 2457310 | 12/1980 | France . | |
| 53-13284 | 5/1978 | Japan . | |
| 58-98742 | 6/1983 | Japan . | |
| 62-87974 | 4/1987 | Japan . | |
| 1-36938 | 8/1989 | Japan . | |
| 1-260461 | 10/1989 | Japan . | |
| 1-54696 | 11/1989 | Japan . | |
| 1-57341 | 12/1989 | Japan . | |
| 2-32365 | 2/1990 | Japan . | |
| 4-20905 | 4/1992 | Japan . | |

OTHER PUBLICATIONS

Ullmann's Encyclopedia of Industrial Chemistry, vol. A3, pp. 320, 321, Allen, Colour Chemistry, Sec. 17-1, p. 261, Sec. 17-2 pp. 264-266.

Dien, The Chemistry of Synthetic Dyes, pp. 80-89; 108-113; Ullmann's Encyclopedia of Industrial Chemistry, vol. A2, pp. 402-403.

*Primary Examiner*—John Goodrow

*Attorney, Agent, or Firm*—McGlew and Tuttle

[57] ABSTRACT

A charge control agent for positive charging whose active ingredient is a salt-forming compound represented by the following formula and a positively chargeable toner for developing electrostatic images comprising at least one kind of the charge control agent, a coloring agent and a resin.

wherein X represents an alkyl group, a cycloalkyl group, a substituted or unsubstituted phenyl group, or —$COR^5$ in which $R^5$ is a lower alkyl group; Z represents a hydrogen, a hydroxyl group or an alkyl group; $R^1$ and $R^3$ independently represent an alkyl group having 1 to 18 carbon atoms or a benzyl group; $R^2$ represents an alkyl group having 5 to 18 carbon atoms; and $R^4$ represents an alkyl group having 1 to 4 carbon atoms or a benzyl group.

20 Claims, 2 Drawing Sheets

□THE PRESENT INVENTION

+COMPARATIVE EXAMBLE b

□THE PRESENT INVENTION

+COMPARATIVE EXAMBLE b

CHARGE CONTROL AGENT AND POSITIVELY CHARGEABLE TONER FOR DEVELOPING ELECTROSTATIC IMAGES

BACKGROUND OF THE INVENTION

1. Field of the Invention

The present invention relates to a positively chargeable toner for developing electrostatic latent images in electrophotography, electrostatic recording, electrostatic printing, etc. and a charge control agent for positive charging capable of controlling the amount of charges of the toner.

2. Description of the Prior Art

In copying machines etc. based on electrophotography, various dry or wet toners containing a coloring agent, a fixing resin and other substances are used to visualize the electrostatic latent image formed on the photoreceptor having a light-sensitive layer containing an inorganic or organic photoconductive substance.

The chargeability of such toners is one of the most important factors in electrostatic latent image-developing systems. Thus, to appropriately control the amount of charges of the toner, a charge control agent providing a positive or negative charge is often added to the toner.

Examples of conventional charge control agents providing a negative charge for toners include the chromium complex salts, cobalt complex salts and iron complex salts of azo dyes, which have a relatively good charging property. Examples of conventional charge control agents providing a positive charge for toners include the nigrosine dyes disclosed in Japanese Patent Examined Publication No. 2427/1966 and other publications. However, many of these charge control agents are relatively dense colored.

For the charge control agent to be generally applicable to color toners of various colors, it is required to be colorless or light-colored to such extent that it does not adversely affect the tones of the color toners. Charge control agents for negative charging known to meet this requirement include chromium complex salts, zinc complex salts, aluminum complex salts and boron complex salts of aromatic hydroxycarboxylic acids such as salicylic acid and alkylsalicylic acid or aromatic dicarboxylic acids; silicon derivatives of mono- or poly-cyclic diols; and calix(n)arene compounds. On the other hand, charge control agents for positive charging known to meet the above-mentioned requirement include quaternary ammonium salt compounds such as those described in Japanese Patent Examined Publication Nos. 36938/1989, 57341/1989, 54696/1989 and 20905/1992, pyridinium salt compounds such as those described in Japanese Patent Publication Open to Public Inspection (hereinafter referred to as Japanese Patent O.P.I. Publication) Nos. 87974/1987 and 98742/1983, and polyamine resins such as those described in Japanese Patent Examined Publication No. 13284/1978.

However, conventional charge control agents for positive charging are insufficient in compatibility for toner resin and triboelectric charging effect in some cases and cannot contribute to charge stability during multiple repeated use of the toner in other cases. In addition, initial copied images are relatively low in sharpness or the quality of copied images during continuous copying is relatively changeable because the charging rise speed is insufficient. For these reasons, there is a demand for the development of a charge control agent for positive charging free of the above problems to be solved for charge control agents for color toners.

The object of the present invention is to provide a charge control agent for positive charging which is versatile for use in various color toners, including the three subtractive primaries yellow, magenta and cyan colors, and achromatic toners, which is excellent in charge control property stability to changes in temperature and humidity, i.e., environmental resistance, charge control property stability over time, i.e., storage stability, and charge control property stability during multiple repeated use of toner, i.e., durability, and which offers rapid toner charging rise, and a positively chargeable toner for developing electrostatic images which can be used as various chromatic or achromatic toners, which is excellent in environmental resistance, storage stability and durability and which offers rapid charging rise.

SUMMARY OF THE INVENTION

The present inventors found that the above problems, including improvement in toner charging rise speed, can be solved by introducing a substituent to the amino group of the naphthylaminesulfonic acid or derivative thereof such as aminonaphtholsulfonic acid or alkyl-substituted naphthylaminesulfonic acid in the charge control agent of the invention disclosed in Japanese Patent Examined Publication No. 54696/1989. The inventors made further investigations based on this finding, and developed the present invention.

Accordingly, the active ingredient of the charge control agent for positive charging of the present invention is a salt-forming compound represented by the following formula I.

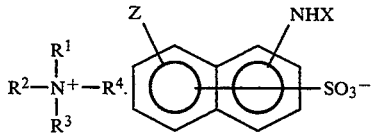

[I]

wherein X represents an alkyl group, a cycloalkyl group, a substituted or unsubstituted phenyl group, or —$COR^5$ in which $R^5$ is a lower alkyl group;

Z represents a hydrogen, a hydroxyl group or an alkyl group;

$R^1$ and $R^3$ independently represent an alkyl group having 1 to 18 carbon atoms or a benzyl group;

$R^2$ represents an alkyl group having 5 to 18 carbon atoms; and $R^4$ represents an alkyl group having 1 to 4 carbon atoms or a benzyl group.

Also, the positively chargeable toner for developing electrostatic images of the present invention comprises at least one kind of charge control agent whose active ingredient is a salt-forming compound represented by formula I, a coloring agent and a resin. In other words, it may contain one kind of such charge control agent or a plurality of kinds of such charge control agent.

Because the salt-forming compound in the charge control agent for positive charging of the present invention is substantially colorless, toner images have almost no tone deterioration even when it is used in various chromatic or achromatic toners. It is excellent in environmental resistance, storage stability and durability. In addition, it is effective in improving the sharpness of initial copied images and stabilizing the quality of copied images during continuous copying because the charging rise speed is high, and it has good affinity and dispersibility for resin.

Also, the positively chargeable toner for developing electrostatic images of the present invention can be used as toners of various chromatic or achromatic colors, and is capable of forming sharp toner images with excellent thin-line reproducibility, and excellent in environmental resistance, storage stability and durability, it offers sharp initial copied images and it can stably provide good copied images even during continuous copying because the charging rise speed is high.

DETAILED DESCRIPTION OF THE INVENTION

Figure 1:
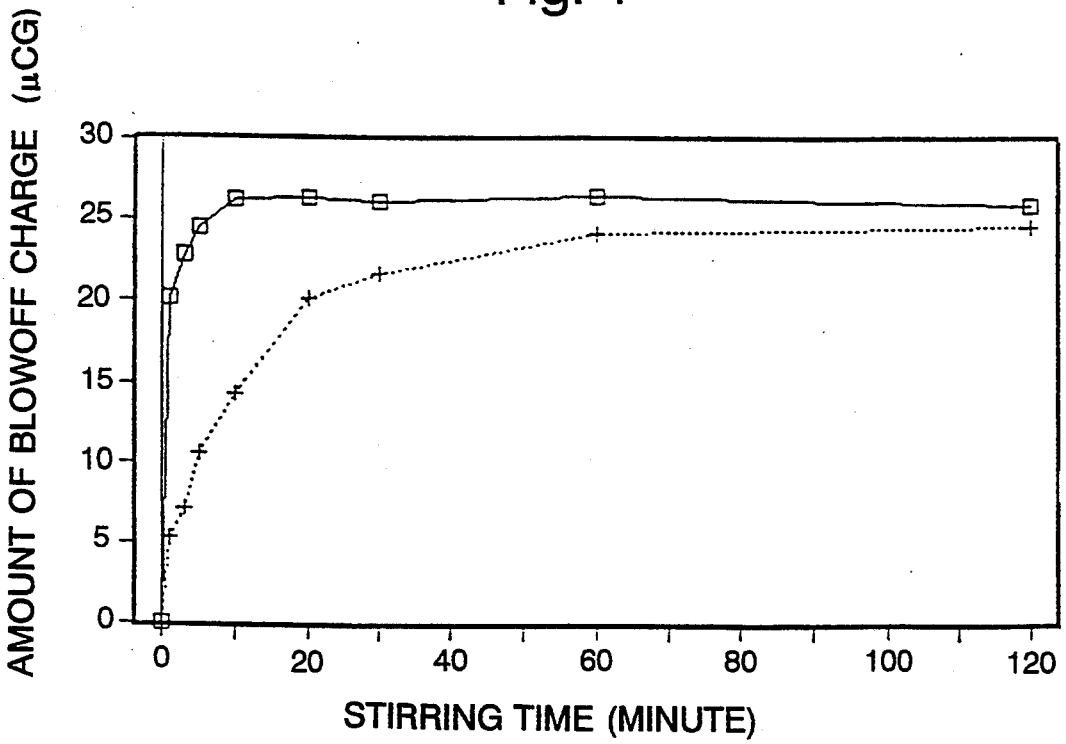
FIG. 1 is a graph comparing toner charging rise characteristics.

The salt-forming compound of the present invention, represented by formula I, can be prepared by forming a salt by a known method between a compound represented by the following formula II:

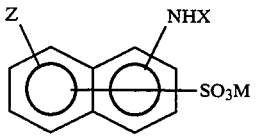

[II]

wherein X represents an alkyl group, a cycloalkyl group, a substituted or unsubstituted phenyl group, or —$COR^5$ in which $R^5$ is a lower alkyl group;

Z represents a hydrogen, a hydroxyl group or an alkyl group; and

M represents a hydrogen or an alkali metal, and a quaternary ammonium salt represented by the following formula III:

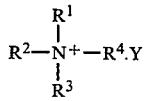

[III]

wherein $R^1$ and $R^3$ independently represent an alkyl group having 1 to 18 carbon atoms or a benzyl group;

$R^2$ represents an alkyl group having 5 to 18 carbon atoms;

$R^4$ represents an alkyl group having 1 to 4 carbon atoms or a benzyl group; and Y represents an inorganic or organic anion.

Examples of X in the above formulas I and II include alkyl groups such as methyl, ethyl, propyl, isopropyl, butyl and tert-butyl, cycloalkyl groups such as cyclohexyl, substituted or unsubstituted phenyl groups such as phenyl, tolyl and xylyl, and acyl groups such as acetyl, propionyl, butyryl and valeryl.

Preferable examples of the compound represented by formula II which is the anion component of a salt-forming compound of the present invention, represented by formula I, include 2-phenylamino-5-naphthol-7-sulfonic acid (hereinafter referred to as N-phenyl J acid), 2-methylamino-5-naphthol-7-sulfonic acid (hereinafter referred to as N-methyl J acid) and 2-acetylamino-5-naphthol-7-sulfonic acid (hereinafter referred to as N-acetyl J acid).

In addition to the above examples, examples of the compound of formula II which is the anion component of the salt-forming compound of the present invention include N-phenyl-substituted derivatives, N-alkyl-substituted derivatives and N-acyl-substituted derivatives from 2-amino-8-naphthol-6-sulfonic acid (hereinafter referred to as γ acid), 1-amino-8-naphthol-4-sulfonic acid (hereinafter referred to as S acid), 4-amino-8-naphthol-6-sulfonic acid (hereinafter referred to as M acid), etc. (e.g., N-phenyl γ acids, N-methyl S acids and N-acetyl M acids); and N-phenyl-substituted derivatives, N-alkyl-substituted derivatives, N-acyl-substituted derivatives, etc. from 1-naphthylamine-4-sulfonic acid, 1-naphthylamine-5-sulfonic acid, 1-naphthylamine-6-sulfonic acid, 1-naphthylamine-7-sulfonic acid, 1-naphthylamine-8-sulfonic acid, 2-naphthylamine-1-sulfonic acid, 2-naphthylamine-6-sulfonic acid, 2-naphthylamine-7-sulfonic acid, 2-naphthylamine-5-sulfonic acid, etc.

With respect to formulas I and III, the alkyl groups represented by $R^1$ through $R^4$, having 1 to 4 carbon atoms, are exemplified by methyl, ethyl, propyl and butyl. Such alkyl groups having 5 to 18 carbon atoms are exemplified by amyl, hexyl, octyl and long-chain alkyl groups such as lauryl, cetyl and stearyl.

Preferable examples of the quaternary ammonium salt represented by formula III which is the cation component of the salt-forming compound of the present invention, represented by formula I, include trioctylmethylammonium chloride,
trilaurylmethylammonium chloride,
triamylbenzylammonium chloride,
trihexylbenzylammonium chloride,
trioctylbenzylammonium chloride,
trilaurylbenzylammonium chloride,
benzyldimethylstearylammonium chloride and
benzyldimethyloctylammonium chloride.

The charge control agent of the present invention has a salt-forming compound which is a combination of an anion component and cation component described above as an active ingredient, having a broad range of positively charging property. The present inventors found that the triboelectric charging property of the charge control agent improves as the molecular weight of the quaternary ammonium of the salt-forming compound increases.

The salt-forming compound for the charge control agent of the present invention preferably have alkyl groups having 5 or more carbon atoms as $R^1$ through $R^3$ in formula I, more preferably have alkyl groups having 8 or more carbon atoms as $R^1$ through $R^3$ in formula I.

Tables 1 and 2 give the results of comparison of triboelectric charging properties of some examples of the salt-forming compound represented by formula I, in which styrene-acrylic resin was used. In Table 1, the compounds wherein n=1, 2 and 4 do not belong to the salt-forming compound represented by formula I, and their triboelectric charging properties are shown for the purpose of comparison. In Tables 1 and 2, the triboelectric charging properties were evaluated in four grades:

◎: Excellent
○: Good
Δ: Fair

×: Unacceptable

TABLE 1

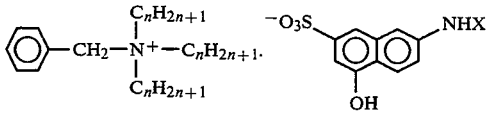

| | X = $CH_3$ | X = $COCH_3$ | X = $C_6H_5$ |
|---|---|---|---|
| n = 1 | x | x | x |
| n = 2 | x | x | x |
| n = 4 | x | Δ | Δ |
| n = 5 | Δ | ∘ | ∘ |
| n = 6 | ∘ | Δ | ∘ |
| n = 8 | ◎ | ◎ | ◎ |

TABLE 2

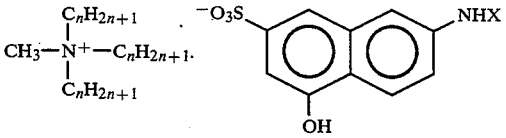

| | X = $CH_3$ | X = $COCH_3$ | X = $C_6H_5$ |
|---|---|---|---|
| n = 6 | Δ | Δ | ∘ |
| n = 8 | ∘ | ∘ | ∘ |
| n = 12 | ◎ | ◎ | ◎ |

Examples of salt-forming compounds preferably used as the charge control agent for positive charging of the present invention are given below.

Example Compound 1

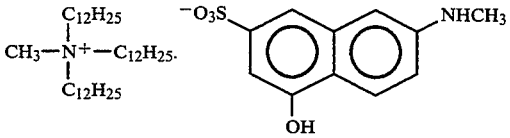

(1)

Pale yellow; melting point: 175.5° to 177.7° C.

Example Compound 2

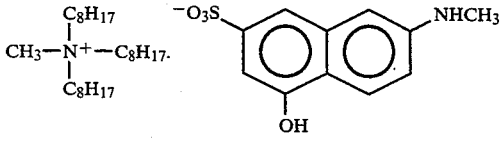

(2)

Pale brown; melting point: 175.1° to 177.7° C.

Example Compound 3

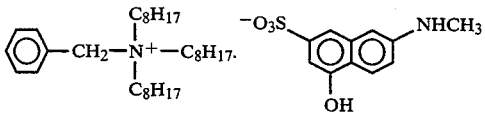

(3)

Pale brown; melting point: 140.2° to 142.8° C.

Example Compound 4

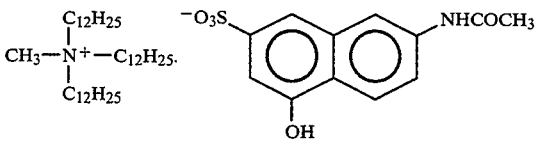

(4)

White; melting point: 166.8° to 168.8° C.

Example Compound 5

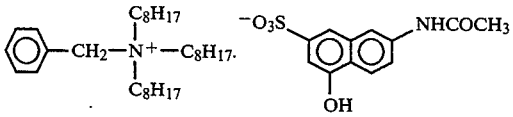

(5)

White; melting point: 145.2° to 147.20 C.

Example Compound 6

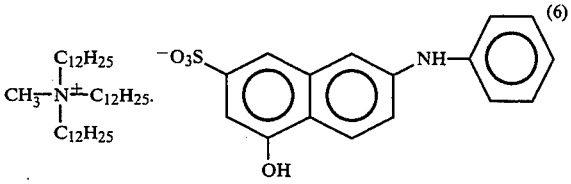

(6)

Pale grey; melting point: 177.3° to 179.1° C.

Example Compound 7

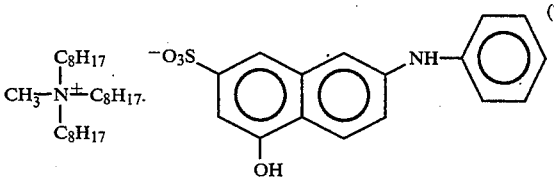

(7)

Pale grey; melting point: 197.9° to 199.6° C.

Example Compound 8

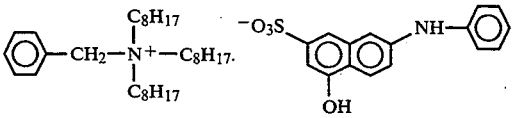

(8)

Pale grey; melting point: 136.5° to 1417° C.

Example Compound 9

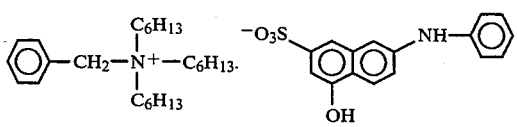

(9)

Pale grey; melting point: 178.2° to 179.6° C.

Example Compound 10

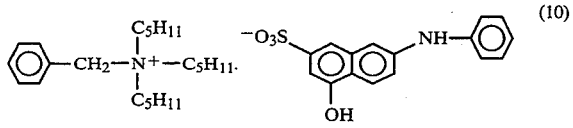

(10)

Pale grey; melting point: 211.7° to 213.0° C.

The positively chargeable toner for developing electrostatic images of the present invention desirably contains a salt-forming compound represented by formula I as the charge control agent of the present invention in a ratio of 0.1 to 10 parts by weight per 100 parts by weight of resin. A more preferable content of the salt-forming compound is 0.5 to 5 parts by weight per 100 parts by weight of the resin.

Also, to improve toner quality, additives such as electroconductive grains, fluidity improving agents and image peeling preventing agents may be added internally or externally to the positively chargeable toner for developing electrostatic images of the present invention.

Examples of resins used in the toner of the present invention include the following known resins or binder resins for use in toners. Specifically, styrene resin, styrene-acrylic resin, styrene-butadiene resin, styrene-maleic acid resin, styrene-vinyl methyl ether resin, styrene-methacrylate copolymer, phenol resin, epoxy resin, polyester resin, polypropylene resin and paraffin wax may be mentioned as examples. These resins may be used singly or in combination.

For preferable use of a resin or binder resin for toners in a toner used for full-color imaging by subtractive mixing or for OHP (overhead projectors) etc., the resin or binder resin is required to have special properties, for example, it should be transparent, substantially colorless (no tone deterioration occurs in the toner image), compatible with the charge control agent of the present invention, fluid under appropriate heat or pressure, and pulverizable.

Examples of such resins for preferable use include styrene resin, acrylic resin, styrene-acrylic resin, styrene-methacrylate copolymer and polyester resin.

The toner of the present invention may incorporate various known dyes and pigments as coloring agents. Examples of such dyes and pigments which can be used in color toners include organic pigments such as carbon black, quinophthalone, Hansa Yellow, Rhodamine 6G Lake, quinacridone, Rose Bengale, copper Phthalocyanine Blue, copper Phthalocyanine Green and diketopyrrolopyrrole pigments, various oil-soluble dyes or disperse dyes such as nigrosine dyes, azo dyes, quinophthalone dyes, anthraquinone dyes, xanthene dyes, triphenylmethane dyes and phthalocyanine dyes, and dyes and pigments processed with higher fatty acid, resin or another substance.

The positively chargeable toner for developing electrostatic images of the present invention may incorporate the above-mentioned coloring agents singly or in combination. Dyes and pigments having a good spectral property can be preferably used to prepare a toner of the three primaries for full-color imaging. Chromatic monocolor toners may incorporate an appropriate combination of a pigment and dye of the same color tone, such as a rhodamine pigment and dye, a quinophthalone pigment and dye, or a phthalocyanine pigment and dye, as a coloring agent.

The toner for developing electrostatic images of the present invention is, for example, produced as follows:

A toner having an average particle size of 5 to 20 μm can be obtained by thoroughly mixing a resin and coloring agent as described above, the charge control agent of the present invention, and, if necessary, a magnetic material, a fluidizing agent and other additives, using a ball mill or another mechanical mixer, subsequently kneading the mixture in a molten state using a hot kneader such as a heat roll, kneader or extruder, cooling and solidifying the mixture, and then pulverizing the mixture and classifying the particles.

Other applicable methods include the method in which the starting materials are dispersed in a binder resin solution, followed by spray drying, and the polymerizing toner production method in which a given set of starting materials are mixed in a monomer .for binder resin to yield an emulsified suspension which is then polymerized to yield the desired toner (e.g., the methods described in Japanese Patent O.P.I. Publication Nos. 260461/1989 and 32365/1990.

When using the toner of the present invention as a two-component developer, development can be achieved by the two-component magnetic brush developing process or another process, using the toner in mixture with carrier powder.

Any known carrier can be used. Examples of the carrier include iron powder, nickel powder, ferrite powder and glass beads of about 50 to 200 μm in particle size, and such materials as coated with acrylate copolymer, styrene-acrylate copolymer, styrene-methacrylate copolymer, silicone resin, polyamide resin, ethylene fluoride resin or the like.

When using the toner of the present invention as a one-component developer, an appropriate amount of fine powder of a ferromagnetic material such as iron powder, nickel powder or ferrite powder may be added and dispersed in preparing the toner as described above. Examples of developing processes which can be used in this case include contact development and jumping development.

EXAMPLES

The present invention is hereinafter described in more detail by means of the following examples, but the invention is never limited by these examples. In the description below, "part(s) by weight" are referred to as "part(s)" for short.

Example 1: Synthesis of Example Compound 6

To a mixture of 20.74 g of N-phenyl J acid and 300 ml of water, sodium hydroxide was added to obtain a pH of 7.0. To this mixture being kept at 45° C., a 50% methanol solution of 55.85 g of trilaurylmethylammonium chloride was added drop by drop over a period of 60 minutes. After completion of the dropwise addition, the liquid mixture was stirred at 80° C. for 1 hour. After the liquid mixture was left to cool, the solid which separated out in the liquid was collected by filtration and washed, after which it was dried, to yield 63.87 g of a pale grey powder having a melting point of 177.3° to 179.1° C. (yield: 93.8%).

Example 2: Synthesis of Example Compound 4

35.84 g of a white powder having a melting point of 166.8° to 168.8° C. (yield: 56.2%) was obtained in the same manner as in Example 1 except that the N-phenyl J acid was replaced with 37.50 g of N-acetyl J acid.

Example 3: Synthesis of Example Compound 2

45.91 g of a pale brown powder having a melting point of 175.1° to 177.7° C. (yield: 84.0%) was obtained in the same manner as in Example 1 except that the N-phenyl J acid and trilaurylmethylammonium chloride were replaced with 20.74 g of N-methyl J acid and 39.67 g of trioctylmethylammonium chloride, respectively.

Example 4

Styrene-acrylic copolymer resin [HIMER SMB600 (trade name), produced by Sanyo Kasei Co., Ltd.] . . . 100 parts Oil-soluble magenta dye [Oil Pink #312 (trade name), produced by Orient Chemical Industries Ltd.] . . . 3 parts Low polymer polypropylene [Biscal 500-P (trade name), produced by Sanyo Kasei Co., Ltd.] . . . 5 parts Example Compound 2 . . . 1.5 parts The above ingredients were uniformly pre-mixed using a high-speed mixer, and then kneaded in a molten state using an extruder, cooled, and roughly milled in a vibration mill. The obtained coarse product was finely pulverized using an air jet mill equipped with a classifier to obtain a magenta toner of 10 to 20 μm in particle size.

5 parts of this toner was admixed with 95 parts of an iron powder carrier [TEFV 200/300 (trade name), produced by Nippon Teppun Co., Ltd.) to yield a developer.

This developer was found to be +26.0 μC/g in the amount of initial blowoff charge. The amounts of initial blowoff charges of this developer under low-temperature low-humidity condition (5° C., 30% relative humidity) and high-temperature high-humidity condition (35° C., 90% relative humidity) were +26.3 μC/g and +25.9 μC/g , respectively, indicating very high environmental stability. The storage stability of this developer was also good.

When this developer was used for a commercial copying machine to form toner images, fog-free distinct magenta color images with good thin-line reproducibility, excellent spectral property and transparency suitable for superposing color mixing were obtained, with no image quality deterioration even after 70,000 copies were continuously taken.

Example 5

Polyester resin [HP-313 (trade name), produced by The Nippon Synthetic Chemical Industry, Co., Ltd.] . . . 100 parts Quinoline dye [C.I. Disperse Yellow 64] . . . 3 parts Low polymer polypropylene [Biscal 500-P (trade name), produced by Sanyo Kasei Co., Ltd.] . . . 5 parts Example Compound 6 . . . 1 part The above ingredients were treated in the same manner as in Example 4 to yield a yellow toner, which was then used to prepare a developer.

This developer was found to be +25.7 μC/g in the amount of initial blowoff charge. The amounts of initial blowoff charges of this developer under low-temperature low-humidity condition (5° C., 30% relative humidity) and high-temperature high-humidity condition (35° C., 90% relative humidity) were +25.4 μC/g and +25.2 μC/g , respectively, indicating very high environmental stability. The storage stability of this developer was also good.

When toner images were formed in the same manner as in Example 4, this developer gave fog-free distinct yellow images with good thin-line reproducibility, excellent spectral property and transparency suitable for superposing color mixing.

Example 6

Polyester resin [HP-313 (trade name), produced by The Nippon Synthetic Chemical Industry, Co., Ltd.] . . . 100 parts Low polymer polypropylene [Biscal 500-P (trade name), produced by Sanyo Kasei Co., Ltd.] . . . 5 parts Blue dye [Varifast Blue #2606 (trade name), produced by Orient Chemical Industries Ltd.] . . . 3 parts Example Compound 5 . . . 1 part The above ingredients were treated in the same manner as in Example 4 to yield a blue toner, which was then used to prepare a developer.

This developer was found to be +24.3 μC/g in the amount of initial blowoff charge. The amounts of initial blowoff charges of this developer under low-temperature low-humidity condition (5° C., 30% relative humidity) and high-temperature high-humidity condition (35° C., 90% relative humidity) were +24.1 μC/g and +23.7 μC/g , respectively, indicating very high environmental stability. The storage stability of this developer was also good.

When images were formed in the same manner as in Example 4, this developer gave fog-free distinct cyan images with good thin-line reproducibility, excellent spectral property and transparency suitable for superposing color mixing.

When images copied on an OHP sheet were projected on a screen using OHP, distinct cyan pictures were obtained.

Example 7

Styrene-acrylic copolymer resin [HIMER SMB600 (trade name), produced by Sanyo Kasei Co., Ltd.] . . . 100 parts Carbon black [MA-100 (trade name), produced by Mitsubishi Chemical Industries, Ltd.] . . . 6 parts Low polymer polypropylene [Biscal 500-P (trade name), produced by Sanyo Kasei Co., Ltd.] . . . 5 parts Example Compound 4 . . . 1 part The above ingredients were treated in the same manner as in Example 4 to yield a black toner, which was then used to prepare a developer.

This developer was found to be +29.2 μC/g in the amount of initial blowoff charge. The amounts of initial blowoff charges of this developer under low-temperature low-humidity condition (5° C., 30% relative humidity) and high-temperature high-humidity condition (35° C., 90% relative humidity) were +28.6 μC/g and +28.4 μC/g , respectively, indicating very high environmental stability. The storage stability of this developer was also good.

When images were formed in the same manner as in Example 4, this developer gave fog-free black images with good thin-line reproducibility.

Example 8

Styrene-2-ethylhexyl methacrylate copolymer resin (80/20) . . . 100 parts

Ferrosoferric oxide [EPT-500 (trade name), produced by Toda Kogyo Corporation] . . . 40 parts Low polymer polypropylene [Biscal 500-P (trade name), produced by Sanyo Kasei Co., Ltd.] . . . 10 parts Carbon black [MA-100 (trade name), produced by Mitsubishi Chemical Industries, Ltd.] . . . 5 parts Example Compound 7 . . . 2 parts The above ingredients were uniformly pre-mixed using a ball mill to yield a premix, which was then kneaded in a molten state at 180° C. using a twin-screw extruder [PCM-30 (trade name), produced by Ikegai Seisakusho Co., Ltd.], cooled and thereafter roughly crushed, finely pulverized and classified to yield a one-component toner of 5 to 15 μm in particle size.

When this toner was used for a commercial copying machine (produced by Canon Inc.) to form toner images, fog-free high-quality images with good thin-line reproducibility having a solid portion reflection density of 1.36 were obtained.

Comparative Test 1

To compare the actual imaging performance, magenta toner and a developer were prepared and used to form toner images in the same manner as in Example 4 except that Example Compound 2 was not used. Since image scattering, disturbance, fogging, etc. occurred, the toner was judged as inappropriate.

Comparative Test 2

A black toner and a developing agent were prepared in the same manner as in Example 7 except that Example Compound 4 was replaced with Example Compound 6.

A black toner and a developing agent (Comparative Example a) were prepared in the same manner as in Example 7 except that Example Compound 4 was replaced with the following Comparative Compound 1.

To compare the toner charging rise characteristics, the amount of blowoff charges of the above two developers were measured with various developer stirring times. The results are shown in Table 3 and FIG. 1.

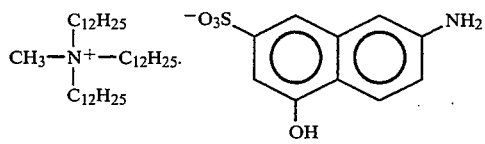

(1)

Pale yellow; melting point: 166.8° to 168.8° C.

TABLE 3

| | Stirring Time | | | | | | | |
|---|---|---|---|---|---|---|---|---|
| | 1 分 minute | 3 分 minutes | 5 分 minutes | 10 分 minutes | 20 分 minutes | 30 分 minutes | 60 分 minutes | 120 分 minutes |
| The Present Invention (μC/g) | +20.2 | +22.8 | +24.5 | +26.2 | +26.4 | +26.1 | +26.5 | +25.9 |
| Comparative Example a (μC/g) | +5.3 | +7.1 | +10.5 | +14.3 | +20.1 | +21.7 | +24.1 | +24.6 |

Comparative Test 3

A black toner and a developing agent were prepared in the same manner as in Example 7 except that Example Compound 4 was replaced with Example Compound 5.

A black toner and a developing agent (Comparative Example b) were prepared in the same manner as in Example 7 except that Example Compound 4 was replaced with the following Comparative Compound 2.

Figure 2:
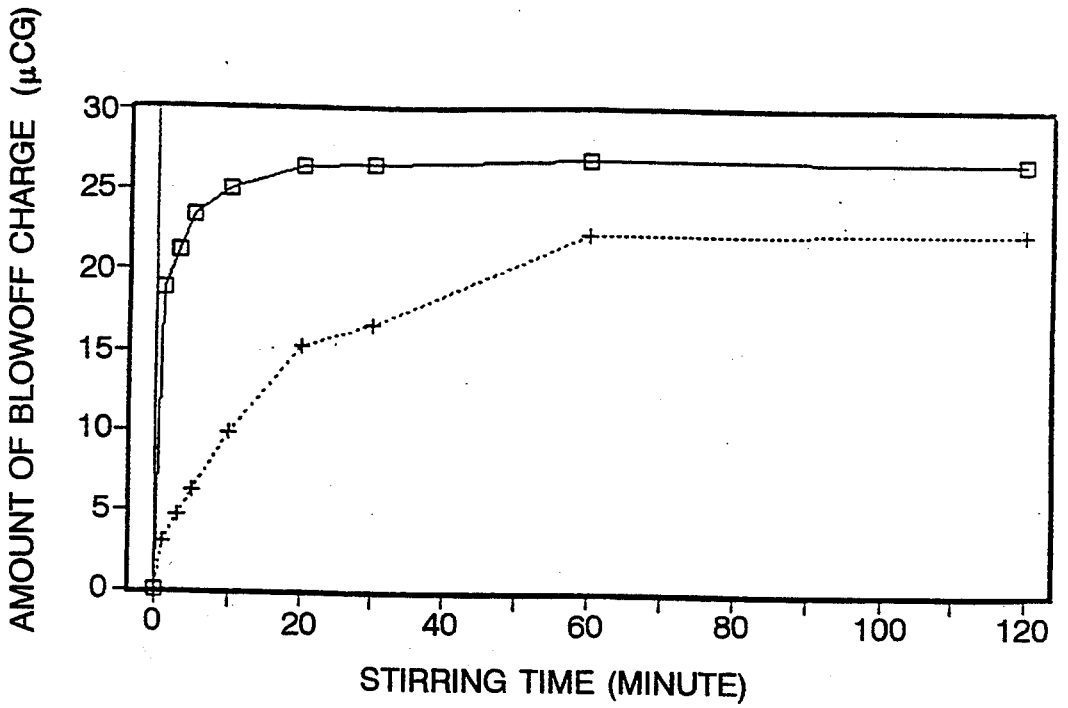
FIG. 2 is another graph comparing toner charging rise characteristics.

To compare the toner charging rise characteristics, the amount of blowoff charges of the above two developers were measured with various developer stirring times. The results are shown in Table 4 and FIG. 2.

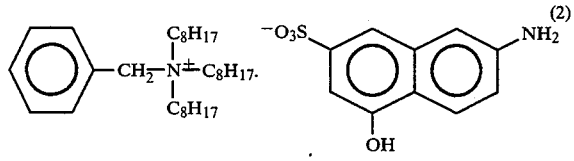

(2)

Pale yellow; melting point: 119.8° to 123.0° C.

TABLE 4

| | Stirring Time | | | | | | | |
|---|---|---|---|---|---|---|---|---|
| | 1 分 minute | 3 分 minutes | 5 分 minutes | 10 分 minutes | 20 分 minutes | 30 分 minutes | 60 分 minutes | 120 分 minutes |
| The Present Invention (μC/g) | +18.8 | +21.1 | +23.4 | +25.0 | +26.5 | +26.6 | +26.9 | +26.8 |
| Comparative Example b (μC/g) | +3.0 | +4.7 | +6.2 | +9.8 | +15.3 | +16.6 | +22.2 | +22.4 |

What is claimed is:

1. A charge control agent for positive charging whose active ingredient is a salt-forming compound represented by the following formula I:

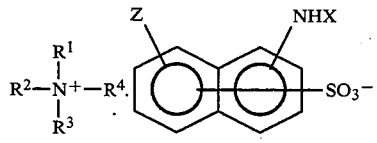

[I]

wherein X represents an alkyl group, a cycloalkyl group, a substituted or unsubstituted phenyl group, or —COR$^5$ in which R$^5$ is a lower alkyl group;

Z represents a hydrogen, a hydroxyl group or an alkyl group;

$R^1$ and $R^3$ independently represent an alkyl group having 1 to 18 carbon atoms or a benzyl group;

$R^2$ represents an alkyl group having 5 to 18 carbon atoms; and $R^4$ represents an alkyl group having 1 to 4 carbon atoms or a benzyl group.

2. The charge control agent of claim 1 wherein the anion component of the salt-forming compound is an aminonaphtholsulfonic acid residue selected from the group consisting of 2-phenylamino-5-naphthol-7-sulfonic acid residue, 2-methylamino-5-naphthol-7-sulfonic acid residue and 2-acetylamino-5-naphthol-7-sulfonic acid residue.

3. The charge control agent of claim 1 wherein the cation component of the salt-forming compound is an ammonium selected from the group consisting of
trioctylmethylammonium,
trilaurylmethylammonium,
triamylbenzylammonium,
trihexylbenzylammonium,
trioctylbenzylammonium,
trilaurylbenzylammonium,
benzyldimethylstearylammonium and
benzyldimethyloctylammonium.

4. The charge control agent of claim 1 wherein $R^1$ through $R^3$ are alkyl groups having 5 or more carbon atoms.

5. The charge control agent of claim 1 wherein $R^1$ through $R^3$ are alkyl groups having 8 or more carbon atoms. $R^3$ in formula I.

6. A positively chargeable toner for developing electrostatic images comprising at least one kind of the charge control agent of claim 1, a coloring agent and a resin.

7. Positively chargeable toner of claim 6 wherein the anion component of the salt-forming compound is an aminonaphtholsulfonic acid residue selected from the group consisting of 2-phenylamino-5-naphthol-7-sulfonic acid residue, 2-methylamino-5-naphthol-7-sulfonic acid residue and 2-acetylamino-5-naphthol-7-sulfonic acid residue.

8. Positively chargeable toner of claim 6 wherein the cation component of the salt-forming compound is an ammonium selected from the group consisting of
trioctylmethylammonium,
trilaurylmethylammonium,
triamylbenzylammonium,
trihexylbenzylammonium,
trioctylbenzylammonium,
trilaurylbenzylammonium,
benzyldimethylstearylammonium and
benzyldimethyloctylammonium.

9. Positively chargeable toner of claim 6 wherein $R^1$ through $R^3$ are alkyl groups having 5 or more carbon atoms.

10. Positively chargeable toner of claim 6 wherein $R^1$ through $R^3$ are alkyl groups having 8 or more carbon atoms.

11. Positively chargeable toner of claim 6 wherein the charge control agent is present in an amount, by weight, of about 0.1 to 10 parts per 100 parts of the resin.

12. Positively chargeable toner of claim 6 wherein the charge control agent is present in an amount, by weight, of about 0.5 to 5 parts per 100 parts of the resin.

13. Positively chargeable toner for developing electrostatic images comprising a toner resin and a positive charging charge control agent comprising a salt-forming compound having an anion component and a cation component and having the formula

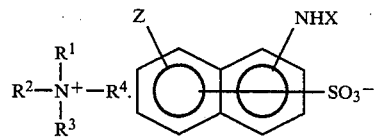

[I]

wherein X is alkyl, cycloalkyl, unsubstituted or substituted phenyl, or —$COR^5$ in which $R^5$ is lower alkyl, Z is hydrogen, hydroxyl or alkyl, $R^1$ and $R^3$ each independently is alkyl having 1 to 18 carbon atoms or benzyl, $R^2$ is alkyl having 5 to 18 carbon atoms, and $R^4$ is alkyl having 1 to 4 carbon atoms or benzyl.

14. Toner of claim 13 wherein the anion component of the salt-forming compound is an aminonaphtholsulfonic acid anion selected from the group consisting of 2-phenylamino-5-naphthol-7-sulfonic acid anion, 2-methylamino-5-naphthol-7-sulfonic acid anion and 2-acetylamino-5-naphthol-7-sulfonic acid anion.

15. Toner of claim 13 wherein the cation component of the salt-forming compound is an ammonium selected from the group consisting of
trioctylmethylammonium,
trilaurylmethylammonium,
triamylbenzylammonium,
trihexylbenzylammonium,
trioctylbenzylammonium,
trilaurylbenzylammonium,
benzyldimethylstearylammonium and
benzyldimethyloctylammonium.

16. Toner of claim 13 wherein $R^1$, $R^2$ and $R^3$ are each alkyl having 5 or more carbon atoms.

17. Toner of claim 13 wherein $R^1$, $R^2$ and $R^3$ are each alkyl having 8 or more carbon atoms.

18. Toner of claim 13 wherein the charge control agent is present in an amount by weight of about 0.1 to 10 parts per 100 parts of the resin.

19. Toner of claim 13 wherein X is lower alkyl, cyclo lower alkyl, phenyl, lower alkyl substituted phenyl or lower alkanoyl, and Z is hydrogen, hydroxyl or lower alkyl.

20. Toner of claim 13 wherein X is alkyl having 1 to 4 carbon atoms, cycloalkyl having 3 to 6 ring carbon atoms, phenyl, alkylphenyl in which the alkyl moiety has 1 to 4 carbon atoms, dialkylphenyl in which each alkyl moiety has 1 to 4 carbon atoms, or alkanoyl having 2 to 5 carbon atoms, and Z is hydrogen, hydroxyl or alkyl having 1 to 4 carbon atoms.

* * * * *